United States Patent [19]

Uken et al.

[11] Patent Number: 4,662,692

[45] Date of Patent: May 5, 1987

[54] SEALING MEMBER

[75] Inventors: William D. Uken, Fremont; Robert S. Dubrow, Redwood City, both of Calif.

[73] Assignee: Raychem Corp., Menlo Park, Calif.

[21] Appl. No.: 730,403

[22] Filed: May 2, 1985

[51] Int. Cl.[4] ..... H01R 4/24

[52] U.S. Cl. ..... 339/96

[58] Field of Search ..... 339/60, 94, 96, 97, 339/97 R, 98, 99 R

[56] References Cited

U.S. PATENT DOCUMENTS 3,241,095 3/1966 Phillips ..... 339/99 R 3,989,338 11/1976 Fosser ..... 339/96

4,504,699 3/1985 Dones et al. ..... 174/84

*Primary Examiner*—Joseph H. McGlynn

*Attorney, Agent, or Firm*—Dennis E. Kovach; Herbert G. Burkard

[57] ABSTRACT

A termination block sealing member includes a continuous layer of insulating gel enclosed around its perimeter by a plastic container such that exposed faces of the gel are open, one exposed face being disposed adjacent a termination block, with another exposed face being oriented such that any one of a plurality of electrical contact pins can be pierced therethrough so as to make contact with terminations in the termination block.

13 Claims, 4 Drawing Figures

SEALING MEMBER

BACKGROUND OF THE INVENTION

The present invention relates to a sealing member useable for sealing contact pins.

Prior art methods of sealing contact pins generally utilize greases which lack any type of three-dimensional structural network which results in the greases generally being viscous and flowing when subjected to temperature and humidity cycling, which provides a relatively unstable means for protecting the pins. In addition, greases, once applied are difficult to remove making inspection and/or repair difficult. Epoxies have also been used, but they are also disadvantageous in that reentry is difficult.

Several gel type materials are known in the prior art for protecting various types of members from both corrosion and electrical discharge. However, prior art constructions utilizing gels involve placing the gel in a container with the container being disposed around a substrate so as to deform the gel and produce a plane of weakness therein. Such constructions are generally useful for protecting singular substrates per container used. Also, the containers are disadvantageous since the gel and its container must be entirely removed from the substrate whenever reentry is desired.

SUMMARY OF THE INVENTION

Accordingly, it is an object of the invention to eliminate the above-noted drawbacks of the prior art, and to provide a sealing member which is simple in construction, relatively inexpensive to make, and which is designed such that any one of a plurality of electrical contact pins can easily and readily be connected to or disconnected from a terminal block without removing the sealing member which is placed adjacent thereto.

These and other objects are achieved by an apparatus which comprises a layer of continuous precured gel, the gel being elastic, conformable, having a cone penetration between 100 and 350 ($10^{-1}$ mm), an ultimate elongation in excess of 100%, and a container for containing the gel disposed around at least a part of an outer surface of the gel, the container and the gel subsequent to being cured being disposed adjacent a terminal block usable for connecting the electrical contact pins such that an exposed face of the gel is in contact with the block, and such that an opposite exposed face of the gel is not covered by the container which allows the electrical contact pins to be inserted therethrough so as to pierce through the gel and therefor be capable of making contact on the block side of the gel. The gel is constructed of an open loop three-dimensional network, suitable materials being urethanes, silicones, or nonsilicones liquid rubbers with little or no unsaturation, the material used for forming the gel being such that upon being penetrated by an electrical contact pin and upon the pin being removed therefrom, the gel self heals and again forms a continuous layer which prevents water and moisture from being transmitted therethrough. Most preferably, an outer surface of the gel is made tacky so as to facilitate contact with the block.

If desired, the continuous layer of gel can be contained within a flexible matrix which comprises a material having a plurality of open interstices having an average volume of less than 0.01 inch$^3$, the gel including a plurality of interconnected segments which lie within the interstices of the matrix, the gel being such that when the matrix and gel are stretched the matrix reaches its ultimate elongation before the gel reaches its ultimate elongation.

DESCRIPTION OF THE PREFERRED EMBODIMENTS

Figure 1:
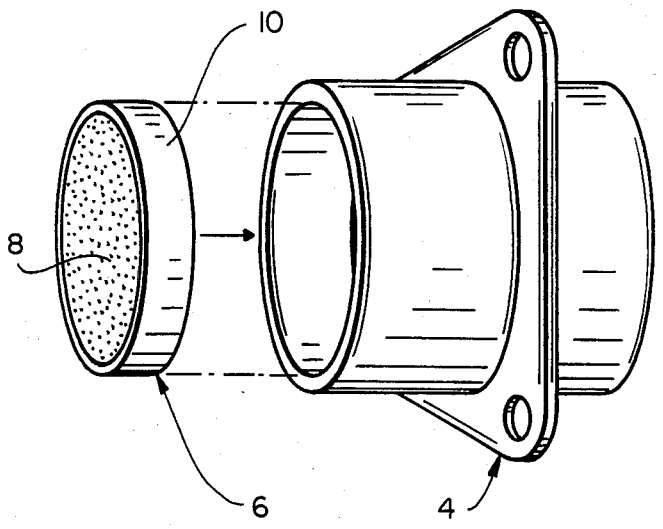
FIG. 1 is a perspective view of an embodiment of the invention prior to installation.
Figure 3:
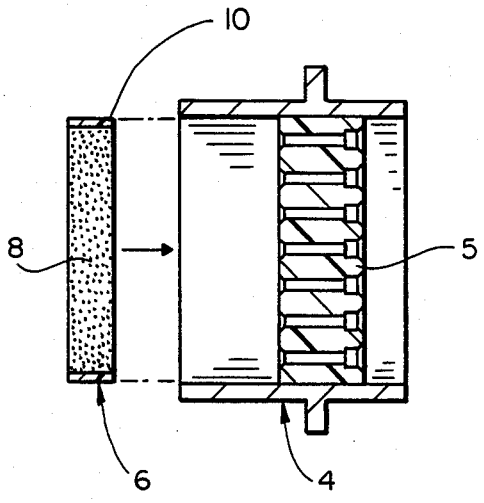
FIGS. 3 and 4 are sectional views of FIGS. 1 and 2.
Figure 2:
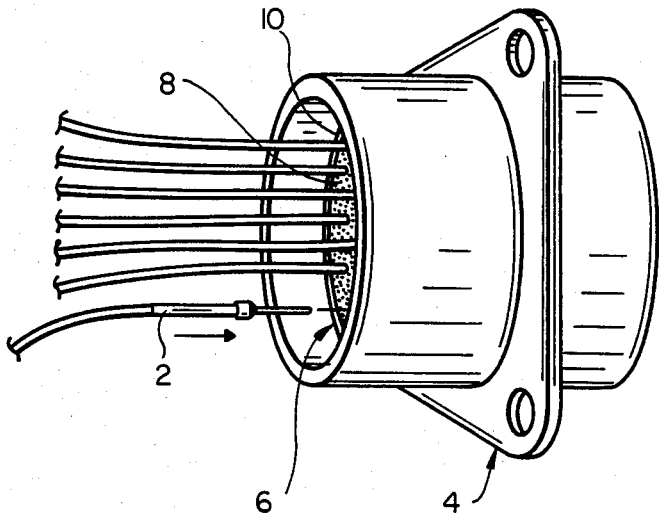
FIG. 2 is a perspective view of a sealing member of the invention installed on a terminal block.
Figure 4:
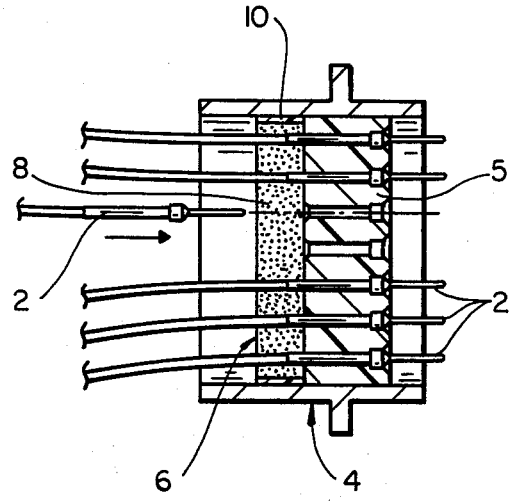

FIGS. 1–4 illustrate a preferred embodiment of the invention, this embodiment illustrating a plurality of electrical contact pins 2 which are to be electrically connected, connection being possible with a terminal or mating connector. A sealing member 6, constructed in accordance with the teachings of the present invention is used to electrically insulate and protect back ends of the pins 2, and specifically entry contact holes 5 therein which function in the embodiment shown to correctly position each of the pins 2 in space. The block 4 can be any one of a variety of types, a common type being the backshell 4 of a military-type circular connector. In the embodiment illustrated, the contact pins 2 are removable from the backshell, though the invention is usable with blocks 4 having non-removable contact pins as well.

The sealing member 6 comprises a continuous gel 8 having an outer circumferencial surface thereof optionally contained by member 10, this member preferably being an outer wall of some type of plastic tubing, such as for example polyethylene, nylon, etc. The member 10 is not required, though it is preferred, its function simply to increase ease of handling the gel which otherwise can be oily to touch and sometimes sticky. The member 10 also aids in keeping the gel 8 in a predetermined shape when the sealing member 6 is stored, handled, etc. Since the pins 2 are relatively small in diameter, the gel 8 comprises a continuous layer having no holes therein prior to being pierced by any one of the pins. According to this embodiment, the gel can be made transparent which is an advantage if location indicia for the pins must be visually determined by looking through the gel.

An alternative preferred embodiment is to dispose the continuous layer of gel within a flexible matrix preferably having a plurality of open interstices having an average volume of less than 0.01 inch$^3$, the gel including a plurality of interconnected segments which lie within the interstices of the matrix, preferably the matrix and the gel being such that when the gel and the matrix are stretched, the matrix reaches its ultimate elongation before the gel reaches its ultimate elongation. If such a matrix is used, the gel can be more easily handled, rendering the member 10 less essential, a drawback of the matrix being that the sealing member created therewith is less transparent than in the embodiment utilizing gel without a matrix.

Preferably, the gel 8 comprises an open loop network which has a cone penetration between 150 and 350 ($10^{-3}$ mm), an ultimate elongation in excess of 100%, these parameters being measured in accordance with American National Standard Designation ASTM-D217 and ASTM-D638, respectively. Preferably, the gel is elastic, is conformable so as to provide excellent contact with the block and pins, and is dielectric so as to be electrically insulating to provide electrical insulation as well as moisture and corrosion protection. Preferably, the gel comprises any material as described in copending U.S. Ser. Nos. 434,011 filed Oct. 12, 1982; 504,000 filed June 13, 1983; 507,433 filed June 23, 1983; and 646,555 filed Oct. 31, 1984, all assigned to the assignee of the present invention, the disclosure of each of these applications being incorporated herein by reference. Particular embodiments of the gel are a urethane, a silicone, or a nonsilicone liquid rubber with low or no unsaturation which has been crosslinked, all such materials being preferred embodiments. In addition, the gel can comprise any kind of rubber material having cone penetration and elongation values in the ranges specified above, such rubbers also being elastic so long as the rubbers are also conformable and capable of self-healing upon removal of any of the pins 2 therefrom subsequent to being pierced thereby.

For a backshell connector as illustrated, the sealing member 6 could be for example approximately ¼ inch thick and have a diameter in size conforming with the internal diameter of the backshell connector.

In the embodiment of FIG. 1, the pins 2 pierce and penetrate through the gel 8 and are available for electrical connection with either terminals or a mating connector. Upon removal of the pins 2 from the sealing member 6, the material of the gel is such that it self-heals and closes a hole previously formed by the pin 2. Since the gel 8 is preferably made of an electrically insulating material as well, electrical isolation of the pins 2 results, and since the gel is an excellent barrier against moisture and water, corrosion protection is also provided. In effect, the gel forms a penetratable, self-healing membrane which can be reentered for repairs as desired numerous times without destroying the functionality of the gel 8.

Though the invention has been described with reference to use with a backshell connector, a particular example being a military backshell connector, it should be understood the invention is equally usable with any type of apparatus wherein electrical conduction pins are to be connected, the invention including all such embodiments. Accordingly, the invention is to be limited only by the appended claims.

We claim:

1. An apparatus for protecting a substrate, comprising:

a partially hollow block having an open face within the block, the open face including a plurality of contact holes therein disposed within a cavity of the block, a layer of continuous precured gel, the gel being cured prior to contacting the substrate, the gel being elastic, conformable, having a cone penetration between 150 and 350 ($10^{-1}$ mm), and an ultimate elongation in excess of 100%, an end of the substrate piercing completely through the gel so as to be capable of being electrically connected, the gel being made of a material such that the pierced gel closely conforms to the substrate subsequent to being pierced thereby, the gel being made from a material which self-heals and provides a moisture barrier subsequent to removal of the substrate therefrom;

a container member in contact with an outer circumferential surface of the gel to facilitate handling thereof, the gel contained by the container member being thereafter inserted into the cavity of the hollow block adjacent the contact holes therein.

2. The apparatus of claim 1, the gel being elastic.

3. The apparatus of claim 1, the gel being shaped substantially like a cylinder with the container member being disposed around an outer cylindrical surface thereof.

4. The apparatus of claim 3, the gel having an exposed cyclindrical end face through which the substrate extends when the gel is pierced thereby.

5. The apparatus of claim 3, the container member being made from a material selected from the group of materials consisting of polyethylene and nylon.

6. The apparatus of claim 1, the gel being disposed against a block, the substrate being a plurality of electrical contact pins connectable with the aide of the block.

7. The apparatus of claim 6, an end face of the gel being in contact with the block adjacent terminal holes therein.

8. The apparatus of claim 7, the block being a backshell connector.

9. The apparatus of claim 1, the gel having a cone penetration between 200 and 300.

10. The apparatus of claim 9, the gel comprising an open loop three-dimensional network.

11. The apparatus of claim 1, the gel being disposed within a flexible matrix.

12. The apparatus of claim 11, the matrix having a plurality of open interstices having an average volume of less than 0.01 $inch^3$, the gel including a plurality of interconnected segments which lie within the interstices of the matrix.

13. The apparatus of claim 12, the matrix and the gel being such that when the gel and the matrix are stretched, the matrix reaches its ultimate elongation prior to the gel reaching its ultimate elongation.

* * * * *